US005226298A

United States Patent [19]

Yamamoto et al.

[11] Patent Number: 5,226,298

[45] Date of Patent: Jul. 13, 1993

[54] THERMOELECTRIC AIR CONDITIONER WITH ABSORBENT HEAT EXCHANGER SURFACES

[75] Inventors: Yoshiaki Yamamoto, Katano; Hisaaki Gyoten, Hirakata; Fumitoshi Nishiwaki, Nishinomiya; Yasushi Nakagiri, Osaka, all of Japan

[73] Assignee: Matsushita Electric Industrial Co., Ltd., Osaka, Japan

[21] Appl. No.: 821,777

[22] Filed: Jan. 16, 1992

[30] Foreign Application Priority Data

Jan. 16, 1991 [JP] Japan ..... 3-3210

[51] Int. Cl.[5] ..... F25B 21/02

[52] U.S. Cl. ..... 62/3.4; 62/284; 62/309; 62/325

[58] Field of Search ..... 62/3.2, 3.3, 3.4, 281, 62/325, 150, 271, 285, 309, 314, 316

[56] References Cited

U.S. PATENT DOCUMENTS 3,077,080 2/1963 Pietsch ..... 62/3.3
3,937,028 2/1976 Alais ..... 62/3.3
4,513,577 4/1985 Wilson ..... 62/281

FOREIGN PATENT DOCUMENTS 57-84942 5/1982 Japan ..... 62/325
57-187538 11/1982 Japan ..... 62/281

*Primary Examiner*—John M. Sollecito
*Attorney, Agent, or Firm*—Wenderoth, Lind & Ponack

[57] ABSTRACT

Corrugated fins are provided at opposing sides of a corrugated thermoelectric device constituting a thermoelectric circuit. This air conditioner is obtained by superposing a plurality of the thermoelectric devices. When a current is fed to the thermoelectric devices, heat is absorbed from one of two fluids running through the corrugated fins and discharged to the other fluid, so as to define a heat pump cycle is defined. The thermoelectric devices are superposed so that the confronting surfaces of the neighboring thermoelectric devices constitute a heat radiation surface respectively and a cooling surface. The corrugated fins intersect with each other, so that the two fluids are prevented from mingling and are allowed to flow in and out of different surfaces.

20 Claims, 5 Drawing Sheets

*Fig. 5* — PRIOR ART
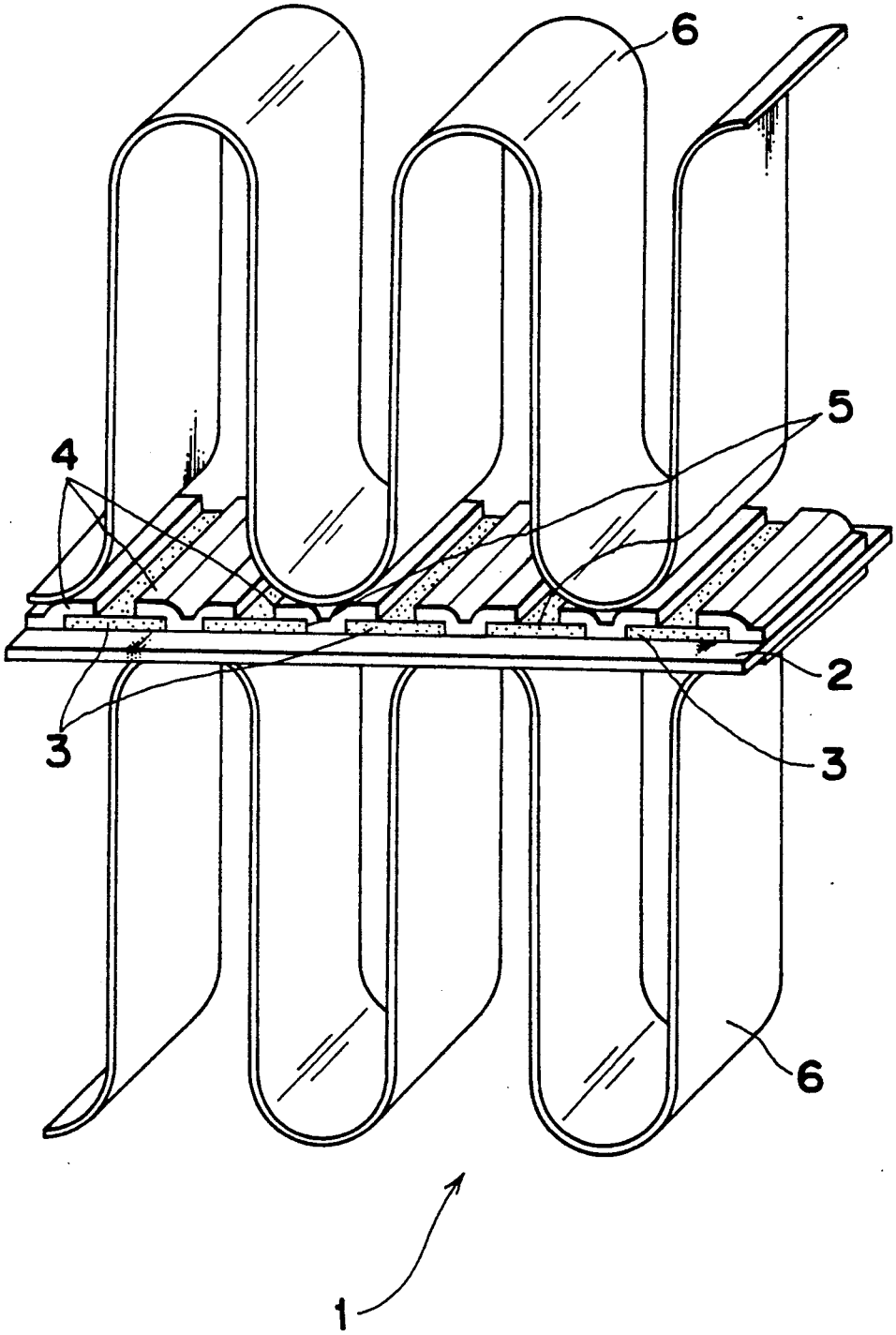

*Fig. 6* — PRIOR ART
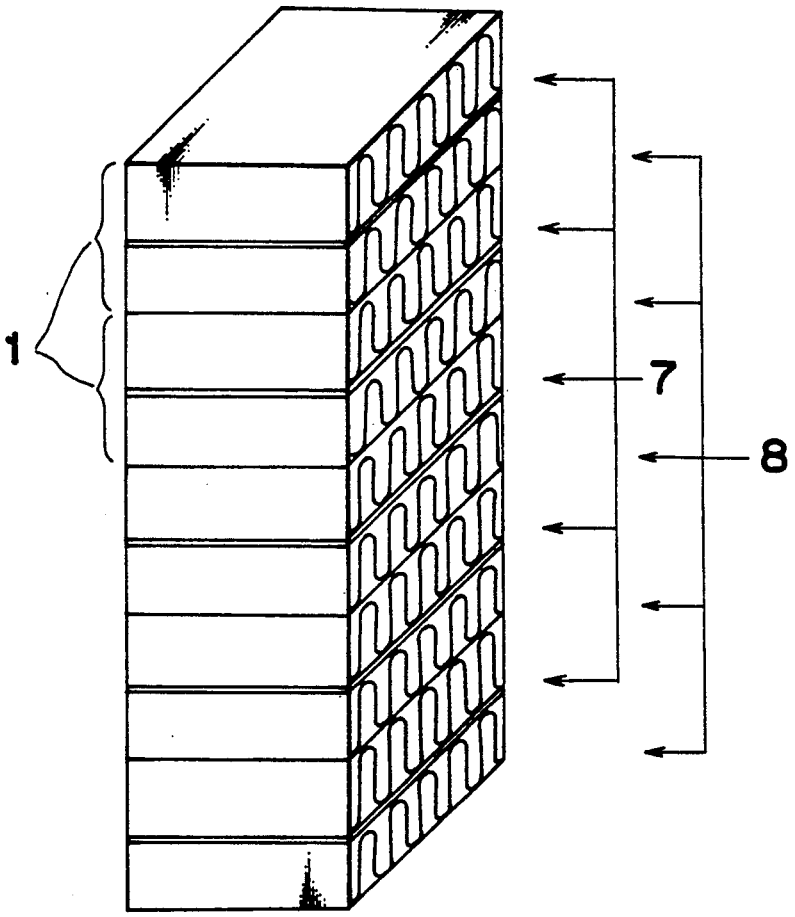

THERMOELECTRIC AIR CONDITIONER WITH ABSORBENT HEAT EXCHANGER SURFACES

BACKGROUND OF THE INVENTION

The present invention relates to an air conditioner utilizing the Peltier effect.

Heat exchange in an air conditioning equipment has been tried in various ways, and particularly, heat exchange using the Peltier effect is nearing practical success.

A conventional example of the air conditioning equipment of the aforementioned type will be depicted hereinbelow with reference to FIGS. 5 and 6.

In FIG. 5, a thermoelectric device 1 which converts heat to electricity or vice versa is provided with fins at either side of a thermoelectric element. The temperature difference between the fins at either side of the element causes the generation of electrical energy and cooling is performed by causing a current to flow in the element. More specifically, as indicated in FIG. 5, there are formed alternately N-type semiconductors 3 and P-type semiconductors 5 on one surface of an insulative film substrate 2 of the device 1 in a longitudinal direction, with a conductors 4 held therebetween. A corrugated fin 6 is placed at each side of the film substrate 2 so as to contact every other conductor 4. Moreover, the corrugated fin 6 on one side of the substrate is in contact with the conductors 4 other than those with which the corrugated fin 6 on the other side of the substrate is in contact. The N-type semiconductors 3 and conductor 4 and, the P-type semiconductors 5 and conductors 4 are overlapped with each other at respective end parts thereof, so that a current entering the thermoelectric device 1 generates or absorbs heat at the interface between each of the semiconductors 3 and 5 and the conductor 4 due to the Peltier effect. At this time, since the N-type and P-type semiconductors 3 and 5 are arranged alternately, the conductors 4 are caused to be heat generating parts and a heat absorbing part alternately. Therefore, the one corrugated fin 6 becomes a heat generating fin and the other corrugated fin 6 becomes a heat absorbing fin. Heat is accordingly absorbed from the air above the film substrate 2, while being dispersed to the air below the film substrate 2, or vice versa.

FIG. 6 illustrates the conventional thermoelectric device 1 when used for air-conditioning. Such air-conditioning equipment requires a vast amount of air and, therefore, many thermoelectric devices 1 as in FIG. 5 are installed in such equipment to guide and exchange the air inside and outside a room. In the equipment, the flow direction of the air for each device 1 is the same. Two streams of air should be introduced separately to the different fins 6 at opposing sides of each device 1, as shown by the arrows 7 and 8. Moreover, it is necessary that the outside air taken from outside the room is discharged outdoors, while the inside air guided from inside the room is discharged indoors. Therefore, according to the conventional thermoelectric device, the flow system for the air is disadvantageously complicated, thereby not only raising the manufacturing cost, but increasing the pressure drop within the flow passage, to result in high power consumption and noise. Even worse, is that during heating with the conventional thermoelectric device, the temperature of the room is raised by emitting heat to the air inside the room, without changing the amount of water vapor included in the air. The relative humidity is lowered as the temperature increases, such that people feel uncomfortably dry.

SUMMARY OF THE INVENTION

The object of the present invention is therefore to provide an air conditioner having a simplified structure for the passage of air so as to enable reduction in manufacturing costs and consumption of electricity.

In accomplishing these and other objects, according to one aspect of the present invention, there is provided an air conditioner comprising: a flat thermoelectric device, the device having one surface as a heating surface and the other surface as a cooling surface; and flow passages respectively provided for two fluids and which are arranged to intersect with each other while holding the thermoelectric device therebetween.

In the above-described structure, the flow passages are intersected with each other and thus the structure of the flow passage for air is made simple, whereby the manufacturing cost and power consumption are reduced remarkably.

According to another aspect of the present invention, there is provided the above-described air conditioner in which a direction of a current fed to the thermoelectric device and the flow passages through which the respective fluids flow can be switched over.

According to the above structure, during heating, the flow passage can be switched between being a cooling portion through which the outside air runs, and a heating portion through which the inside air runs. Therefore, the moisture adhered to the cooling surface or the flow passages when the heat is absorbed from the outside air can to be evaporated when the flow passages are switched and heat is radiated to the inside air.

According to a still another aspect of the present invention, there is provided the an conditioner in which an absorptive material is attached to both of the surfaces of the thermoelectric devices or both of the surfaces of the thermoelectric device are formed of absorptive material.

Since the condensed moisture is absorbed by the absorptive material, it is possible to lengthen the switching interval of the flow passage, and keep the room filled with the moist air. In addition, carbon dioxide, poisonous gas and the like may be discharged outside if a suitable material is used for the absorbent.

BRIEF DESCRIPTION OF THE DRAWINGS

These and other objects and features of the present invention will become clear from the following description taken in conjunction with the preferred embodiments thereof with reference to the accompanying drawings, in which:

FIG. 5 is a structural diagram of a thermoelectric device of a conventional air conditioning apparatus; and FIG. 6 is a schematic structural diagram of the conventional air conditioning apparatus of FIG. 5.

DETAILED DESCRIPTION OF THE INVENTION

Figure 1:
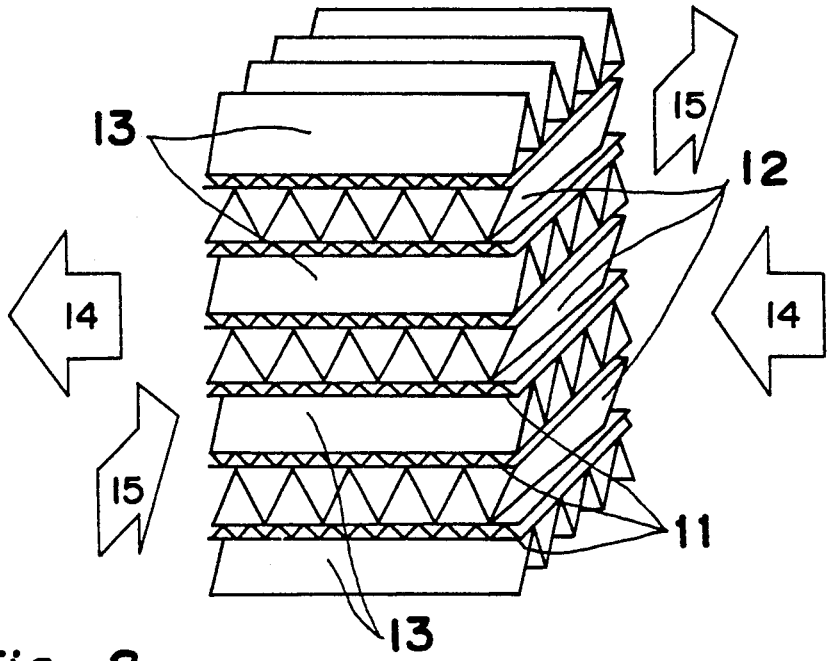
FIG. 1 is a schematic structural diagram of an air conditioner according to one preferred embodiment of the present invention.

Before the description of the present invention proceeds, it is to be noted that like parts are designated by like reference numerals throughout the accompanying drawings.

One preferred embodiment of the present invention will be described with reference to FIGS. 1 and 2.

As shown in the drawings, corrugated fins 12 and 13 are provided on opposing sides of each of a plurality of corrugated thermoelectric devices 11 constituting a thermoelectric circuit. An air conditioner of the embodiment is obtained by superposing the above thermoelectric devices 11 together with the corrugated fins 12 and 13. When a current is fed to the thermoelectric devices 11, heat is absorbed from one of the fluids running through the fins 12 and 13, and discharged to the other fluid, so that a heat pump cycle is formed. The thermoelectric devices 11 are superposed so each of the confronting surfaces of the neighboring devices 11 rendered either a heat radiation surface or a cooling surface. Since the corrugated fins 12 and 13 are directed orthogonal to each other, fluids 14 and 15 flow in and out of the devices 11 from different surfaces, and are prevented from being mixed.

Figure 2:
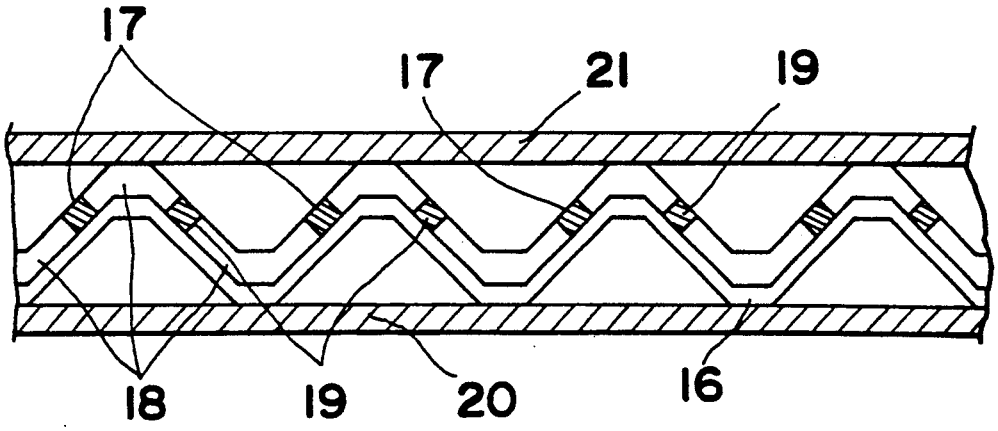
FIG. 2 is a diagram for explaining in detail a thermoelectric device of the air conditioner.

The thermoelectric device 11 is illustrated more concretely in FIG. 2. An N-type semiconductor 17, an electric conductor 18, a P-type semiconductor 19, an electric conductor 18, an N-type semiconductor 17, . . . are sequentially formed on one surface of an insulative film substrate 16 as shown in a longitudinal direction in FIG. 2. Ends of the N-type semiconductor 17, the conductor 18, and the P-type semiconductor 19 are electrically connected with each other, but the electric resistance and thermal resistance at the connections are not large. Copper or aluminum with small electric resistance is used for the conductor 18. The corrugation of the film substrate 16 and of the conductors 18, is such that of the portions of the substrate 16 projecting in a first direction (down in FIG. 2) is in thermal contact with a heat conduction plate 20 and each of the portions of the conductors 18 adjacent portions of the substrate 16 projecting in a second direction opposite the first direction (up in FIG. 2) is in contact with another heat conduction plate 21.

When the above thermoelectric device 11 is used for an air conditioning apparatus, a current flowing through the semiconductors 17 and 19 and the conductors 18 along the insulative film substrate 16 generates heat or absorbs heat because of the Peltier effect at the interfaces between the semiconductors 17 and 19 and conductors 18. Since the N-type semiconductors 17 and the P-type semiconductors 19 are arranged alternately, the conductors 18 are alternately caused to be heat generating parts and heat absorbing parts, so that the heat conduction plate 20 in contact with every other conductor 18 absorbs (or generates) heat. The other heat conduction plate 21 generates (or absorbs) heat. As a result, the heat is absorbed from (or discharged to) the fluid running through the fins 12 or 13 attached above the insulative film substrate 16 and dispersed to (or absorbed from) the fluid running through the fins 13 or 12 attached between the substrate 16.

Figure 3:
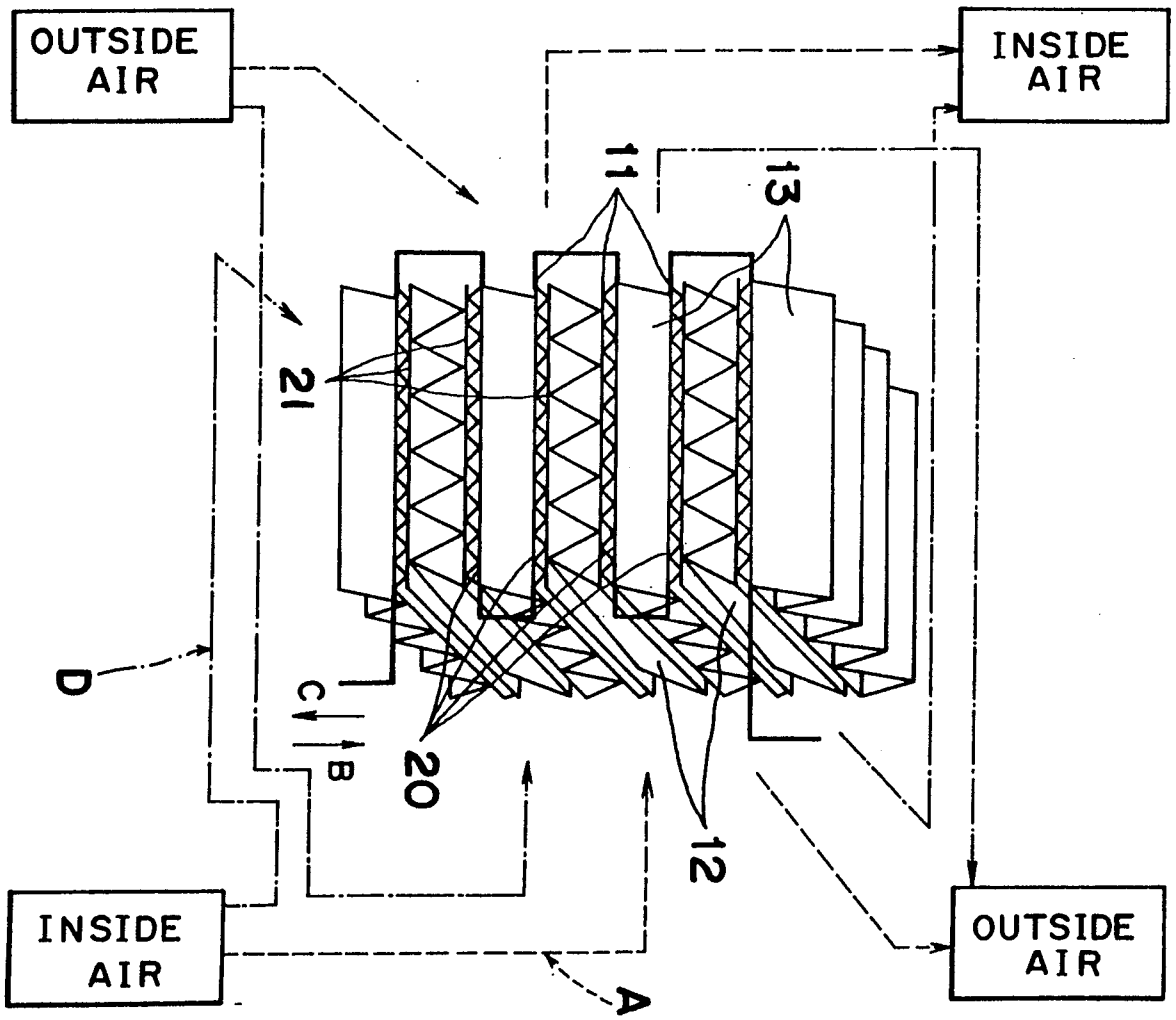
FIG. 3 is a schematic structural diagram of an air conditioner according to a further embodiment of the present invention.

FIG. 3 shows an air conditioner according to a further embodiment of the present invention. The same parts as in the foregoing embodiment are designated by the same reference numerals and the description thereof will be abbreviated here. In the heating mode of the apparatus, the direction of a current fed to the thermoelectric devices 11 is as indicated by the arrow B when the air flows through the fins 13 along the broken line A. Each fin 13 is positioned between the heat conduction plates 20 of the neighboring devices 11 and each fin 12 is positioned between the heat conduction plates 21 of the neighboring devices 11. At this time, each heat conduction plate 20 is a heat radiation surface, and each heat conduction plate 21 is a cooling surface. Therefore, the air inside the room is heated by the heat conduction plate 20, with the water vapor adhered to the heat conduction plates 20 being supplied to the inside air. Accordingly, the inside air is returned at a high temperature and a high humidity to the inside of the room. On the other hand, since the temperature of the heat conduction plate 21 is lower, both heat and water vapor are supplied from the air outside the room circulating around the heat conduction plate 21 and the water vapor is condensed on the heat conduction plate 21. A predetermined time later, the direction of the current is switched as shown by the arrow C and also the air flow is changed to direction indicated by the chain line D to cause the air to flow through the fins 12. Thus, the heat conduction plates 20 and 21 are caused to change to cooling surfaces and heat radiation surfaces, respectively, so that the outside air is cooled by the heat conduction plates 20. Since the water vapor is evaporated from the heat conduction plates 20 before the change, the heat conduction plates 20 take the water vapor form the outside air. The heat conduction plates 21, meanwhile, carry the water vapor, which was absorbed before the change, to the inside air circulating around the heat conduction plates 21. The heat conduction plates 21 transfer the heat to the inside air as well. In the manner as described hereinabove, heat and water vapor are absorbed from the outside air and then discharged to the inside air. Accordingly, cozy air conditioning without drying the air inside the room is realized. Even when the temperature outside the room becomes lower, defrosting is not required, thereby eliminating the uncomfortable feeling experienced when using a conventional air conditioner.

Although the foregoing description of the further embodiment is related to the heating mode, it is needless to say that the dehumidifying effect of the apparatus is also provided in the cooling mode without switching the flow passage of the air if there is provided a discharging means to discharge condensed moisture.

Moreover, it becomes possible to absorb or discharge a large amount of moisture if the fin or heat conduction plates are provided with an absorbent such as silica gel or active carbon, or the fin itself is formed of such an absorbent. This allows the switching interval of the flow passage to be elongated, and the heating efficiency to be improved. Further, if a suitable absorbent. e.g., silica gel or active carbon is used, not only moist air but also carbon dioxide and toxic gases such as nitrogen oxides in the room can be exhausted. That is, the gas scattered in the room is absorbed while the inside air is in contact with the absorbent, and is discharged outdoors when the absorbent is brought in contact with the fresh outside air during exchange of the flow passage. Heat exchange of this manner is effectively performed whether in the heating mode or in the cooling mode. If the fits are provided with slits or louvers, the heat exchange performance is further enhanced.

Figure 4:
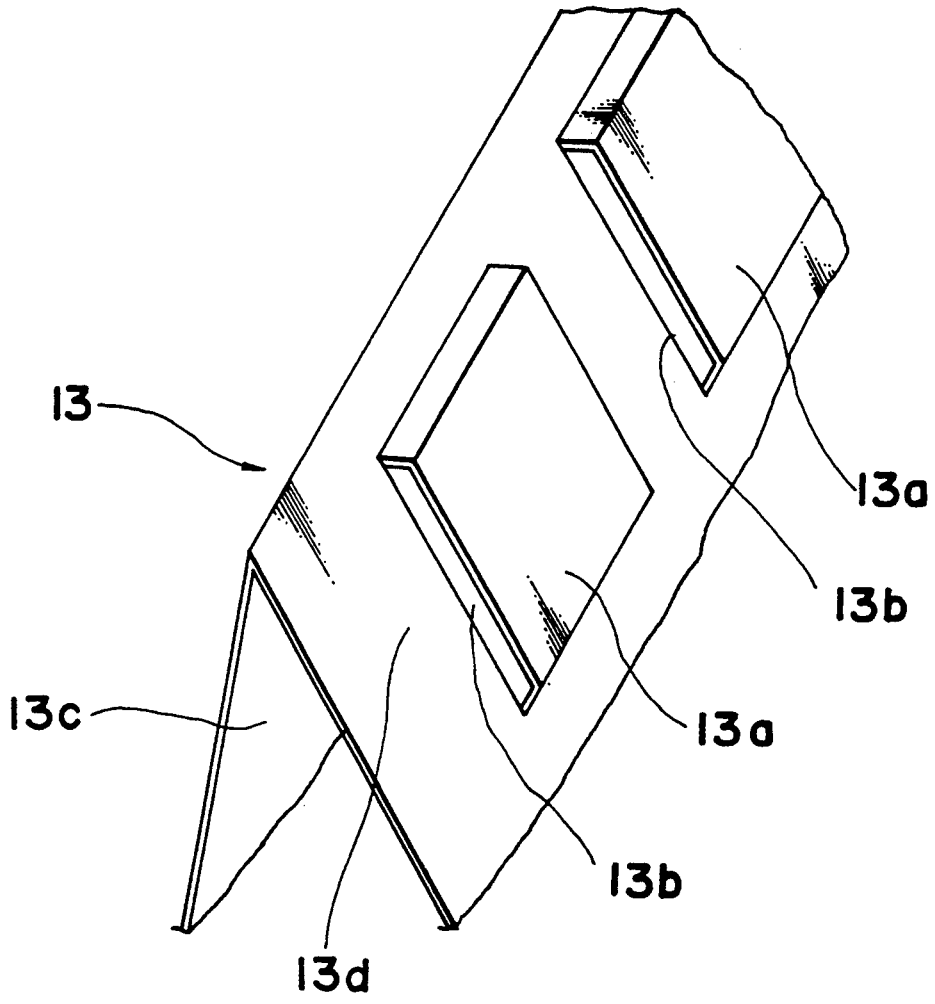
FIG. 4 is an enlarged perspective view of part of a fin according to a modification of the above embodiments.

That is, as shown in FIG. 4, the inclined wall 13*d* of the fin 13 which is located inside the device 11 has a rectangular projection 13*a* to form a slit 13*b* such that the air running through the space 13*c* surrounded by the walls 13*d* and the heat conduction plate 21 flows into the space surrounded by the walls 13*d* and the heat conduction plate 20.

Furthermore, the invention is not limited to corrugated fins 12 and 13 directed orthogonal to one another rather, the fins 12 and 13 can intersect with each other at any angle, such as 60 degrees.

According to the present invention, the flow passages intersect with one another and thus the structure of the flow passage for air is made simple, whereby the manufacturing cost and power consumption are reduced remarkably. The moisture is returned to the air during heating, and therefore the air is prevented from conduction plates 20 and 21 are caused to change to changed to be a cooling being dried as the temperature rises. At the same time, defrosting of the flow passage for the outside air is unnecessary. The present invention provides comfort and an easy-maintenance air conditioner as discussed above.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. An air conditioner comprising:

a flat thermoelectric device having opposing outer surfaces, and being adapted to have an electric current flow therethrough to cause heating of a first of said outer surfaces and cooling of a second of said outer surfaces;

a first flow passage arrangement having flow passage walls and being mounted on said first outer surface along a first direction, said first flow passage arrangement being adapted to have a first fluid flow therethrough in the first direction, said flow passage walls of said first flow passage arrangement being defined partially by said first outer surface;

a second flow passage arrangement having flow passage walls and being mounted on said second outer surface along a second direction non-parallel with said first direction, said second passage arrangement being adapted to have a second fluid flow therethrough in the second direction, said flow passage walls of said second flow passage arrangement being defined partially by said second outer surface; and wherein said flow passage walls of each of said first and second flow passage arrangements are provided with absorptive material and thereby define means for absorbing moisture from one of the first and second fluids and for providing moisture previously absorbed therein to the other of the first and second fluids.

2. An air conditioner as recited in claim 1, wherein said absorptive material comprises a material attached to both of said first and second opposing surfaces.

3. An air conditioner as recited in claim 1, wherein said first and second opposing surfaces are formed of said absorptive material.

4. An air conditioner as recited in claim 1, wherein said first and second flow passage arrangements respectively comprise corrugated fins.

5. An air conditioner as recited in claim 1, wherein said flat thermoelectric device comprises a first heat conductor plate which includes said first outer surface, a second heat conductor plate which includes said second outer surface, and a corrugated fin mounted between said first and second heat conductor plates, said corrugated fin having first ridge portions projecting in a first projecting direction and contacting said first conductor plate and second ridge portions projecting in a second projecting direction opposite said first projecting direction and contacting said second conductor plate.

6. An air conditioner as recited in claim 5, wherein said corrugated fin comprises a corrugated fin-shaped series of elements and a corrugated fin-shaped insulative film substrate mounted on one side of said corrugated fin-shaped series of elements, said corrugated fin-shaped series of elements including a plurality of electrical conductors, a plurality of P-type semiconductors and a plurality of N-type semiconductors; and said corrugated fin-shaped series of elements is arranged with each of said electrical conductors connected between one of said N-type semiconductors and one of said P-type semiconductors and located at one of said first and second ridge portions.

7. An air conditioner as recited in claim 6, wherein said absorptive material comprises a material attached to at least some of said flow passage walls of said first and second flow passage arrangements.

8. An air conditioner as recited in claim 6, wherein at least some of said flow passage walls of said first and second flow passage arrangements are formed of said absorptive material.

9. An air conditioner as recited in claim 6, wherein slit-shaped openings are formed in at least some of said flow passage walls of said first and second flow passage arrangements to allow the first and second fluids to flow between individual passages of said first and second flow passage arrangements, respectively.

10. An air conditioner as recited in claim 6, wherein said flow passage walls of said first and second flow passage arrangements are partially defined by corrugated fins, respectively, such that a plurality of individual flow passages are formed for each of said first and second flow passage arrangements and are defined within said flow passage walls constituted by said first and second outer surfaces, respectively, and said corrugated fins of said first and second flow passage arrangements, respectively.

11. An air conditioner as recited in claim 1, wherein said flow passage walls of said first and second flow passage arrangements are partially defined by corrugated fins, respectively, such that a plurality of individual flow passages are formed for each of said first and second flow passage arrangements and are defined within said flow passage walls constituted by said first and second outer surfaces, respectively, and said corrugated fins of said first and second flow passage arrangements, respectively.

12. An air conditioner as recited in claim 1, wherein said flat thermoelectric sheet constitutes a means for conducting current in either of two opposing directions;

said first flow passage arrangement constitutes a means for allowing either the first fluid or the second fluid to flow therethrough; and said second flow passage arrangement constitutes a means for allowing either the second fluid or the first fluid to flow therethrough.

13. An air conditioner as recited in claim 12, wherein said first and second flow passage arrangements respectively comprise corrugated fins.

14. An air conditioner as recited in claim 12, wherein said flat thermoelectric device comprises a first heat conductor plate which includes said first outer surface, a second heat conductor plate which includes said second outer surface, and a corrugated fin mounted between said first and second heat conductor plates, said corrugated fin having first ridge portions projecting in a first projecting direction and contacting said first conductor plate and second ridge portions projecting in a second projecting direction opposite said first projecting direction and contacting said second conductor plate.

15. An air conditioner as recited in claim 14, wherein said corrugated fin comprises a corrugated fin-shaped series of elements and a corrugated fin-shaped insulative film substrate mounted on one side of said corrugated fin-shaped series of elements, said corrugated fin-shaped series of elements including a plurality of electrical conductors, a plurality of P-type semiconductors and a plurality of N-type semiconductors; and said corrugated fin-shaped series of elements is arranged with each of said electrical conductors connected between one of said N-type semiconductors and one of said P-type semiconductors and located at one of said first and second ridge portions.

16. An air conditioner as recited in claim 15, wherein said absorptive material comprises a material attached to at least some of said flow passage walls of said first and second flow passage arrangements.

17. An air conditioner as recited in claim 15, wherein at least some of said flow passage walls of said first and second flow passage arrangements are formed of said absorptive material.

18. An air conditioner as recited in claim 15, wherein slit-shaped openings are formed in at least some of said flow passage walls of said first and second flow passage arrangements to allow the first and second fluids to flow between individual passages of said first and second flow passage arrangements, respectively.

19. An air conditioner as recited in claim 15, wherein said flow passage walls of said first and second flow passage arrangements are partially defined by corrugated fins, respectively, such that a plurality of individual flow passages are formed for each of said first and second flow passage arrangements and are defined within said flow passage walls constituted by said first and second outer surfaces, respectively, and said corrugated fins of said first and second flow passage arrangements, respectively.

20. An air conditioner as recited in claim 12, wherein said flow passage walls of said first and second flow passage arrangements are partially defined by corrugated fins, respectively, such that a plurality of individual flow passages are formed for each of said first and second flow passage arrangements and are defined within said flow passage walls constituted by said first and second outer surfaces, respectively, and said corrugated fins of said first and second flow passage arrangements, respectively.

* * * * *